United States Patent [19]

Terasaki

[11] 4,354,883

[45] Oct. 19, 1982

[54] METHOD FOR IMPROVING THE RESIDUAL STRESS IN AUSTENITIC STAINLESS STEEL PIPES AND THE LIKE BY INDUCTION HEATING

[75] Inventor: Masanori Terasaki, Yokohama, Japan

[73] Assignee: Daiichi Kashuha Kogyo Kabushiki Kaisha, Tokyo, Japan

[21] Appl. No.: 46,490

[22] Filed: Jun. 7, 1979

[30] Foreign Application Priority Data

Jun. 7, 1978 [JP] Japan ..... 53/67626

[51] Int. Cl.[3] ..... C21D 9/50

[52] U.S. Cl. ..... 148/127; 148/38; 148/136; 148/154

[58] Field of Search ..... 148/136, 154, 127, 38

[56] References Cited

U.S. PATENT DOCUMENTS 4,168,190 9/1979 Eguchi et al. ..... 148/154

4,229,235 10/1980 Matsuda et al. ..... 148/154

*Primary Examiner*—R. Dean

*Attorney, Agent, or Firm*—L. Lawton Rogers, III

[57] ABSTRACT

A method for improving the residual stress in austenitic stainless steel pipes and the like by induction heating is disclosed.

9 Claims, 8 Drawing Figures

METHOD FOR IMPROVING THE RESIDUAL STRESS IN AUSTENITIC STAINLESS STEEL PIPES AND THE LIKE BY INDUCTION HEATING

BACKGROUND OF THE INVENTION

In atomic power plants or thermoelectric power plants, austenitic stainless steel pipes (hereinafter referred to as "stainless steel pipes") are often laid out in the form of one piping system constructed by welding and connecting straight pipes, curved pipes and joint pipes. In piping systems of this type, occurrence of damages so-called "stress corrosion cracks" is often observed in the vicinity of welded portion. It has been clarified that this stress corrosion crack is due to the tensile stress caused by thermal influences at the step of welding stainless steel pipes and left in the inner faces of the pipes, sensitizaton of the steel structure in the pipes and other factors combined therewith. Accordingly, there have been proposed various methods in which causes of the stress corrosion crack owing to thermal influences at the welding step are eliminated. For example, there can be mentioned a method in which the residual tensile stress left in the inner face of a pipe, which is one of causes of the stress corrosion crack, is improved and eliminated. According to this conventional method, as shown in FIG. 1, while the interior of a stainless steel pipe 1 is being cooled by a coolant 2 such as water, a high frequency induction heating element 4 (hereinafter referred to as "induction element") is applied to the outer side of the vicinity 3 of the welded portion 3*a* of the steel pipe 1 so that the welded portion 3*a* is located substantially at the center of the heating width of the induction element 4 and the vicinity 3 of the welded portion is induction-heated from the outside, whereby a thermal stress exceeding the yield point is generated in the heated portion while producing a sufficient temperature difference between the inner face 11 and outer face 10 of the steel pipe 1. Then, the heated portion is cooled naturally to the ambient temperature to eliminate the temperature difference between the inner and outer faces of the pipe.

In this known method, since the vicinity 3 of the welded portion of the stainless steel pipe 1 is located substantially at the center in the widthwise direction of the induction element, a sufficient temperature difference can be produced between the inner and outer faces in this pipe 1 at the heating step and it is possible to produce a compression yield in the outer face 10 of the pipe and a tensile yield in the inner face 11 of the pipe. Accordingly, if this temperature difference is eliminated by stopping the heating, the portion which has undergone the compression yield in the outer face of the pipe is pulled and the portion which has undergone the tensile yield in the inner face of the tube is compressed. As a result, the tensile residual stress is left in the outer face 10 of the pipe and the compressive residual stress is left in the inner face 11 of the pipe. Accordingly, in the inner face 11 where the tensile stress given by thermal influences at the welding step is left, an effect of the previous residual stress is moderated or shifting the previous residual stress to the compression side. However, it has been found that a serious difficulty is involved in this method.

More specifically, when the above method is applied to a piping system which has already been laid out in an atomic power plant or the like, it is not always possible to locate the vicinity of the welded portion, where the residual stress is to be improved, substantially at the center in the widthwise direction of the induction element. In those cases, the portion where improvement of the residual stress is required is not sufficiently heated and it is impossible to produce a temperature difference sufficient to improve the residual stress between the inner and outer faces of the heated portion.

For example, if the welded portion 3*a* is a T-shaped branched portion of the piping system as shown in FIG. 2, since other pipe crossing the pipe having the welded portion 3*a* gets in the way, the welded portion 3*a* cannot be located substantially at the center of the heating width of the induction element 4. Therefore, even if heating is carried out in this state, the heating temperatures on the inner and outer faces of the vicinity 3 of the welded portion and the temperature differences are as shown by a temperature distribution curve of FIG. 2 and it is impossible to provide heating temperatures and temperature differences sufficient to improve the residual stress in the inner and outer faces of the pipe.

This disadvantage is due to a characteristic property of an ordinary induction heating element that a high heat generation density is obtained substantially at the center in the widthwise direction thereof.

Accordingly, it may be expected that if an induction element capable of providing a high heat generation density on each of both the side ends in the widthwise direction thereof, the above-mentioned difficulty will be overcome and eliminated. However, it is actually impossible to sufficiently eliminate the above difficulty only by using a conventional induction element which is arranged so that a heat generating density on a material located on one side end portion in the widthwise direction of the induction element can be increased.

DETAILED DESCRIPTION OF THE PREFERRED EMBODIMENTS

Generally, in the heating method using a high frequency induction heating element, the heat generation density on a material to be heated is reduced toward the side end in the widthwise direction of the induction element, and it is known that this difference of the heat generation density can be reduced to some extent by decreasing the clearance between the material to be heated and the induction element.

Figure 3:
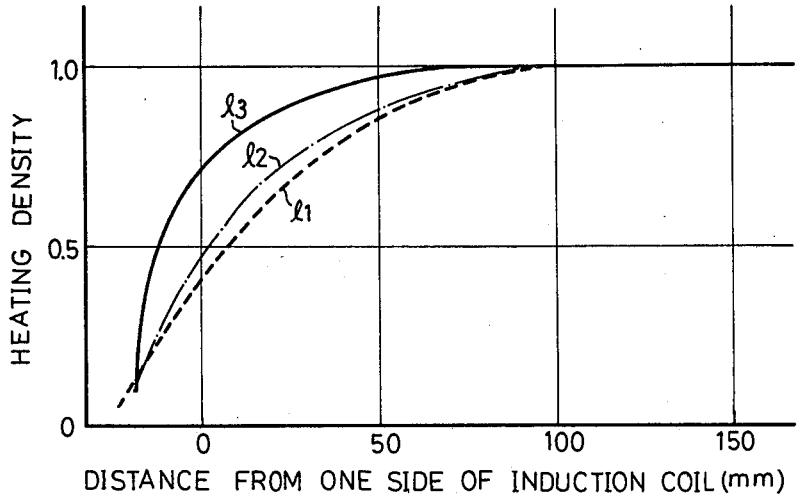
FIG. 3 is a clearance-heat generation density curve illustrating the relation of a clearance between an induction element and a material to be heated to the heat generation density.

FIG. 3 illustrates the distribution of the heat generation density between the central portion and side end portion of the induction element, which is observed when a material is heated by a multi-wound induction element would entirely at an equal pitch while maintaining the clearance between the material to be heated and the induction element at 30 mm, 20 mm or 10 mm. In FIG. 3, curves 11, 12 and 13 show results obtained when the clearances are 30 mm, 20 mm and 10 mm, respectively.

As is seen from FIG. 3, if the clearance between the induction element and the material to be heated is decreased, the heat generation density on the material located at the side end portion of the induction element can be increased to some extent but cannot be elevated to a level substantially equal to the heat generation density at the central portion of the induction element. Furthermore, if the clearance is decreased excessively, in case of a multi-wound induction element, heating non-uniformity is brought about between the portion just below coiled lines and the portion intermediate between coiled lines, and no good heating state can be attained and no substantial improvement of the residual stress can be expected. Still further, in view of the fact that the treatment for improving the residual stress is mainly conducted on a piping system already laid out in an atomic power plant or the like, difficulties are inevitably involved in the operation of setting induction elements and in maintenance of safety at the step of driving these induction elements. Accordingly, the disadvantage involved in the above-mentioned conventional method cannot be eliminated only by reducing the clearance between the induction element and the material to be heated.

Figure 4:
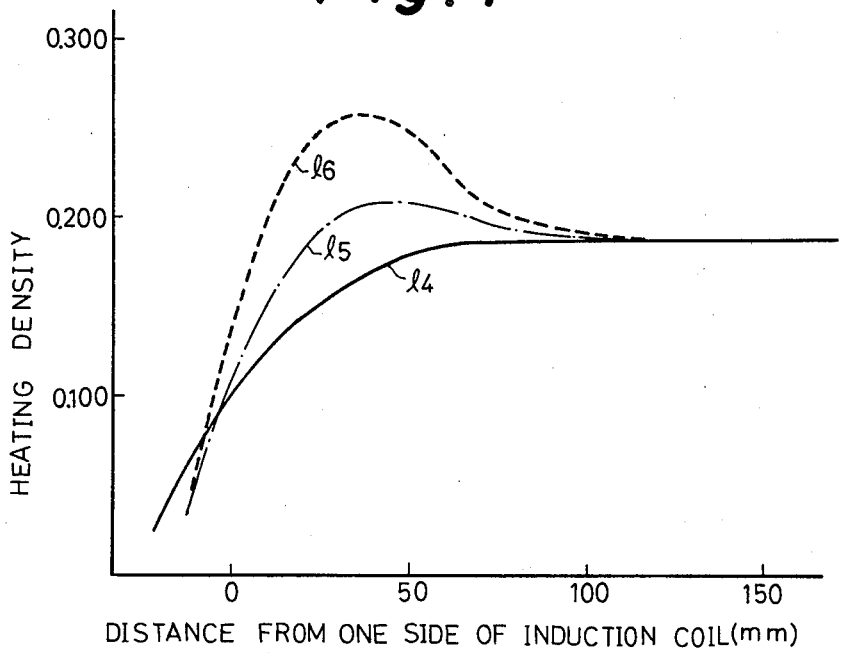
FIG. 4 is a pitch-heat generation density curve illustrating the relation of a winding pitch on the side end portion of an induction element to the heat generation density.

Another characteristic property of the multi-wound induction heating element is that if the ratio of winding pitch in the side end portion of the induction element is made lower than that in the central portion in the widthwise direction of the induction element, the heat generation density on a material to be heated, which is located in the side end portion of the induction element, can be increased (see FIG. 4). In FIG. 4, curve 14 indicates the heat generation density on a material heated ay an induction element where the winding pitch is uniform from the central portion to the side end portion of the induction element, curve 15 indicates the heat generation density on a material heated by an induction element where the ratio of the winding pitch in the side end portion of the element to the winding pitch in the central portion of the element is about 0.8, and curve 16 indicates the heat generation density on a material heated by an induction element where the winding pitch is reduced toward the side end portion of the element so that the ratio of the winding pitch in the side end portion of the element to the winding pitch in the central portion of the element is about 0.7 to about 0.6. Incidentally, the clearance between the induction element and the material to be heated is adjusted to 20 mm in each case.

From FIG. 4, it is seen that if a multi-wound induction heating element in which the winding pitch is reduced toward the side end portion of the element is employed, reduction of the heat generation density in the side end portion of the induction element wound entirely at an equal pitch can be compensated. However, if the winding pitch is reduced in one side end portion of a multi-wound induction element, on setting this induction element there should inevitably be conducted a troublesome operation of applying the pitch-reduced portion to the vicinity of the welded portion where improvement of the residual stress is required. In the case where a multi-wound induction element having the winding pitch reduced in one side end portion is disposed so that the welded portion of a material is located at a portion other than the pitch-reduced portion and the heat treatment is carried out for improving the residual stress, before the vicinity of the welded portion is heated to a predetermined temperature, the portion of the material located at the pitch-reduced portion of the induction element is heated to a temperature higher than the necessary level and undesirable phenomena take place (for example, if the temperature is elevated above 550° C., sensitization of the texture is caused). Therefore, this method is not practically effective for improving the residual stress.

Figure 5:
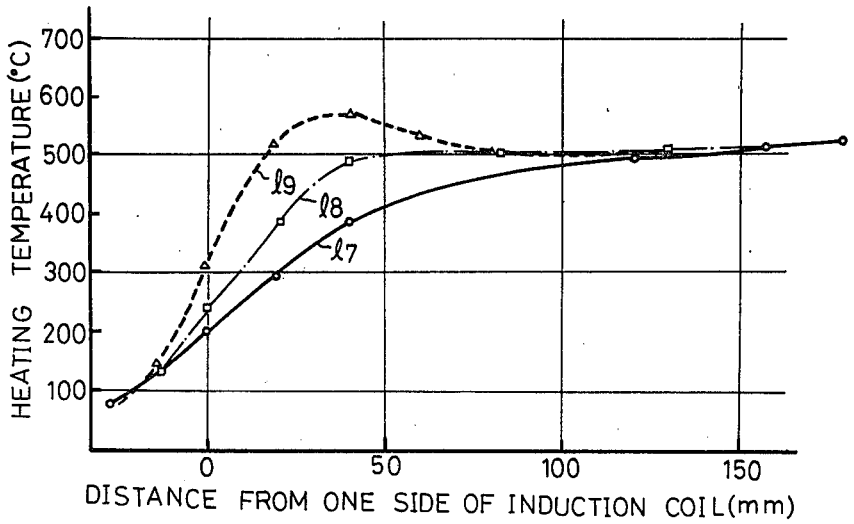
FIG. 5 is a pitch-temperature curve illustrating the relation between a winding pitch on the side end portion of an induction element and a heating temperature.

Based on data obtained by experiments, an induction element entirely wound at an equal pitch, an induction element where the winding pitch in the side end portion was adjusted to 0.8 of the winding pitch in the central portion and an induction element where the winding pitch in the side end portion was adjusted to 0.6 of the winding pitch in the central portion were prepared, and materials were heated by using these elements to determine temperature distributions. Obtained results are shown in FIG. 5. In FIG. 5, curve 17 indicates the temperature distribution obtained by the equal-pitch induction element, and curves 18 and 19 indicate temperature distributions obtained by the induction elements where the winding pitches in the side end portions were reduced to 0.8 and 0.6 of the winding pitch in the central portion, respectively. In each case, the clearance between the induction element and the material to be heated was adjusted to 20 mm.

As is seen from FIG. 5, in the case of an induction element in which the winding pitch in the side end portion was reduced to 0.6 or 0.8 of the winding pitch in the central portion, the temperature of the outer surface of the material in the portion corresponding to the pitch-reduced portion was elevated to about 500° to about 550° C. and other portions of the induction element could elevate the temperature of the material to a level necessary for improving the residual stress.

Through the above-mentioned various experiments and investigations made on heating characteristics of multi-wound induction heating elements, we found that if the clearance between a material to be heated and an induction heating element and the winding pitch in the side end portion of the induction element are appropriately adjusted, even if the portion of the material to be heated for improving the residual stress is located in the side end portion of the induction element, this portion can be heated effectively for improving the residual stress.

It is therefore a primary object of the present invention to provide a method for improving the residual stress, in which the above-mentioned difficulty involved in the recently proposed method for improving the residual stress in the vicinity of the welded portion of a stainless steel pipe is effectively eliminated, that is, not only when the vicinity of the welded portion where improvement of the residual stress is required is located substantially at the center of an induction element but also when the vicinity of the welded portion is located in the side end portion, the residual stress can be effectively improved.

In accordance with one embodiment of the present invention, this object can be attained by a method for improving the residual stress in anstenitic stainless steel pipes, which comprises heating the vicinity of the welded portion of an austenitic stainless steel pipe from the outside by an induction element while cooling the inside of the vicinity of the welded portion with water or the like, said method being characterized in that heating is carried out by using a multi-wound induction element where the winding pitch of the induction element in the region extending from at least one side end of the induction element along a length 2 to 3 times the clearance between the induction element and the stainless steel pipe in the widthwise direction of the induction element is 0.6 to 0.9 of the winding pitch in the central portion in the widthwise direction of the induction element.

In this embodiment of the method of the present invention, even if the vicinity of the welded portion is located in the side end portion of the induction element, the residual effect can be effectively improved. Prior to illustration of this effect, an example of the multi-wound induction element used in this embodiment will first be described.

In the multi-wound induction element to be used in this embodiment, the width of the region where the winding pitch is reduced is adjusted to 2 to 3 times the clearance between the induction element and the material to be heated, from the side end of the induction element toward the center of the induction element. The reason for this arrangement is that in FIG. 3, the region where the heat generation density is reduced in carrying out induction heating while adjusting the clearance to 10 to 30 mm extends from a point which is separated from the side end of the induction element toward the center thereof by a distance 2 to 3 times the above-mentioned clearance.

The reason why the winding pitch in the above region is reduced to about 0.6 to about 0.9 of the winding pitch in the central portion is that as shown in FIG. 5, if the winding pitch in the pitch-reduced region is 0.9 to 0.6 of the winding pitch in the central portion, a heating temperature necessary for improving the residual stress can be produced in the vicinity of the side end of the induction element, and a heating temperature necessary for improving the stress can be maintained also in the central portion of the induction element while effectively preventing this portion from being excessively heated.

Figure 6:
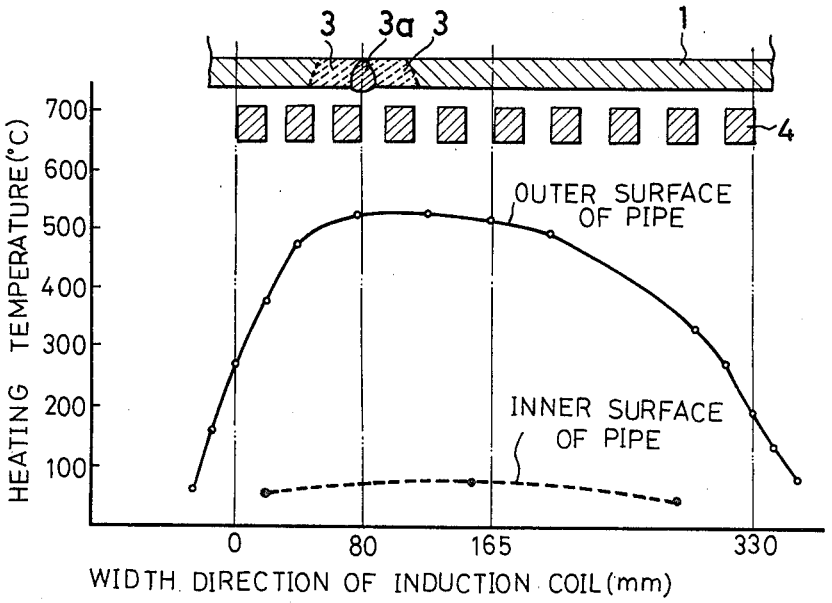
FIG. 6 is a diagram illustrating one heating embodiment in the method of the present invention and a temperature distribution in the inner and outer faces of a stainless steel pipe in this heating embodiment.

The heating temperature distribution in the inner and outer faces of the vicinity of the welded portion of a stainless steel pipe (JIS SUS 304) having a nominal diameter of 20B sch 100 and a thickness of 30.2 mm, observed when the stainless steel pipe was treated according to the method of the present invention, is illustrated in FIG. 6.

More specifically, a 10-wound high frequency induction heating element 4 having a winding pitch of 36 mm in the central portion and a winding pitch of 29 mm, corresponding to about 0.8 of the winding pitch in the central portion, in one side end portion and also having a width of 330 mm was used and a stainless steel pipe 1 was set so that the center of the welded portion 3*a* of the stainless steel pipe 1 was located at a point apart by 80 mm from one side of the induction element 4. Water as a coolant was filled in the interior of this stainless steel pipe 1, and in this state, an electric power was applied to the induction element 4 to actuate the element 4 and effect heating. A temperature distribution as shown in FIG. 6 was obtained.

In this embodiment, it has been confirmed that in the region of this stainless steel tube where the residual stress should be improved in the vicinity of the welded portion (about 15 cm from the center of the welded portion on each side), between the inner and outer faces of the pipe there is a produced a temperature difference of about 400° C. sufficient to reduce the residual tensile stress in the inner face or shift it to the compression side.

Incidentally, the temperature difference $\Delta T$ between the inner and outer faces of an austenitic stainless pipe, which is necessary for reducing the residual tensile stress in the inner face or shifting it to the compression side is calculated according to the following formula:

$$\Delta T \geqq [4(1-\nu)\sigma y]/E\alpha$$

wherein $\alpha$ stands for the thermal expansion coefficient, E stands for Young's modulus, $\sigma y$ stands for the yield strength and $\nu$ stands for Poisson's ratio.

For example, in the case where the steel pipe is composed of JIS SUS 304, if the temperature difference $\Delta T$ is about 220° C. or more, a sufficient improving effect can be attained. However, in order to enhance the effect of improving the residual stress, it is preferred to produce a larger temperature difference.

In the above-mentioned embodiment, the observed temperature difference between the inner and outer faces is about 400° C., which is a value sufficient to attain a significant effect of improving the residual stress.

Accordingly, if the above temperature difference between the inner and outer faces is eliminated after completion of the heat treatment, it is possible to attain the intended effect of eliminating the residual tensile stress in the inner face in the vicinity of the welded portion of the stainless steel pipe or shifting it to the compression side.

In the embodiment illustrated in FIG. 6, a multi-wound induction element in which the winding pitch is reduced to a predetermined level only in one side end portion is employed. In the method of the present invention, when an induction element in which the winding pitch is reduced in both the side end portions in the same manner as described in the foregoing embodiment is employed, even if the vicinity of the welded portion where improvement of the residual stress is required is located at any point substantially along the entire width of the induction element, a sufficient effect of improving the residual stress can be attained.

This embodiment where the winding pitch is reduced in both the end portions of the induction element will now be described by reference to FIG. 7.

Figure 7:
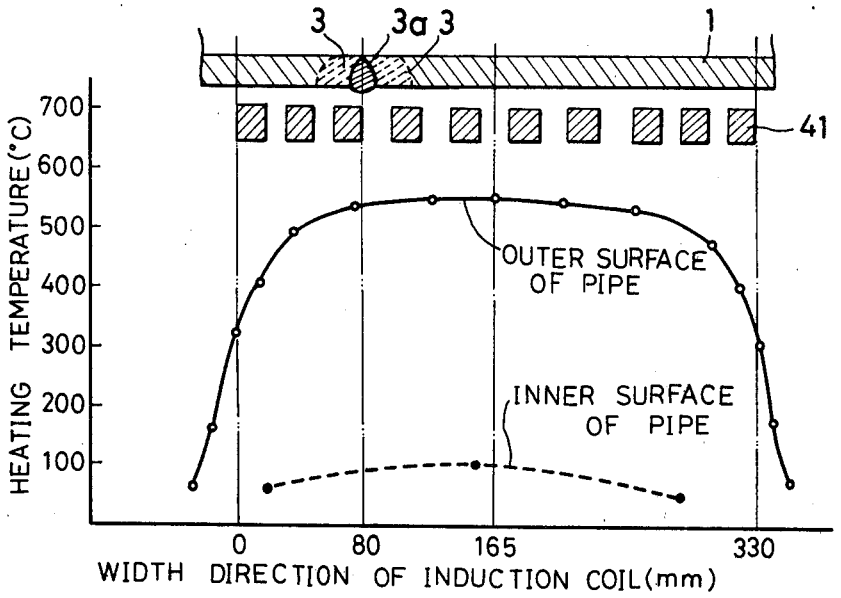
FIG. 7 is a diagram illustrating another heating embodiment in the method of the present invention and a temperature distribution in the inner and outer faces of a stainless steel pipe in this heating embodiment.

In the embodiment illustrated in FIG. 7, a 10-wound induction element 41 having a winding pitch of 39 mm in the central portion and a winding pitch of 29, corresponding to about 0.75 of the winding pitch in the central portion, in both the side end portions, is used, and a stainless steel pipe 1 is set so that the welded portion 3*a* is located at a point apart by 80 mm from one side end of the induction element 41. Water is filled in the interior of the steel pipe 1 and the steel pipe 1 is heated by actuating this induction element 41. The temperature distribution in the inner and outer faces of the steel pipe 41, obtained in this embodiment, is shown in FIG. 7. When this induction element 41 is employed, a temperature difference necessary for improving the residual stress can be produced between the inner and outer faces of the steel pipe 1 substantially along the entire width of the induction element 41. Therefore, if only the portion of the steel pipe where improvement of a stainless pipe is required is located within the width of the induction element, a sufficient effect of improving the residual effect can be attained irrespectively of the position of said portion of the stainless steel pipe.

Figure 1:
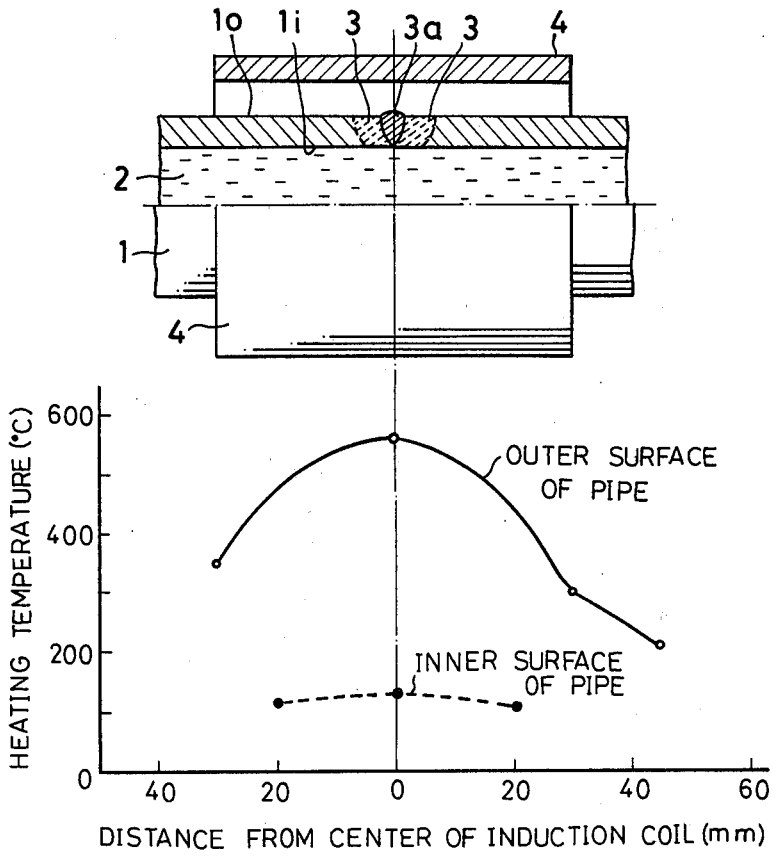
FIG. 1 is a diagram illustrating one embodiment of the conventional method and a temperature distribution in this conventional method.
Figure 2:
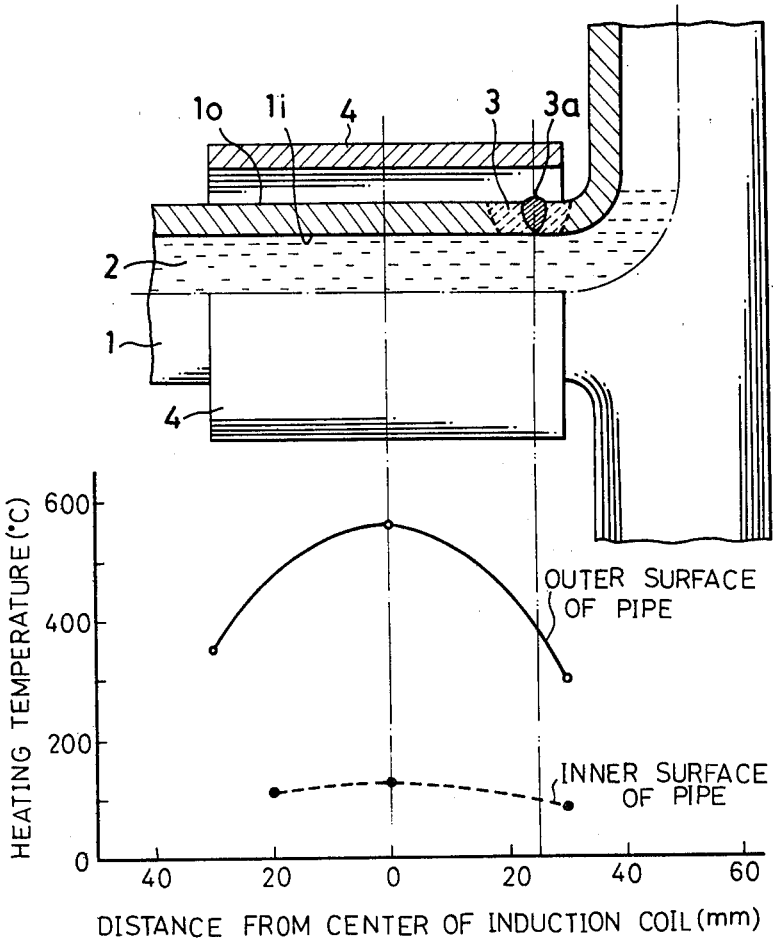
FIG. 2 is a diagram illustrating another embodiment of the conventional method and a temperature distribution in this conventional method.
Figure 8:
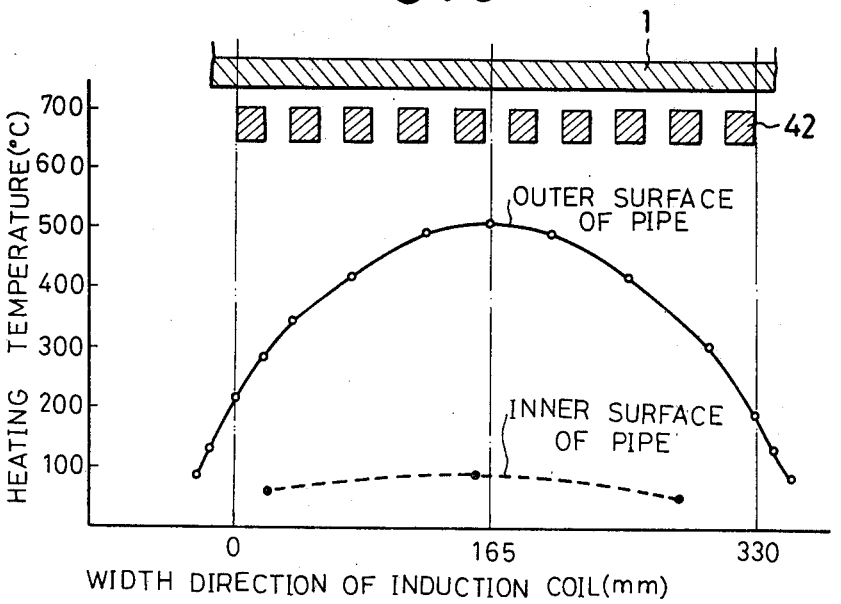
FIG. 8 is a diagram illustrating a temperature distribution in the inner and outer faces of a stainless steel pipe heated by a 10-wound induction element having the same width as that of an induction element used in the method of the present invention and being wound entirely at an equal pitch.

Incidentally, in the conventional method illustrated in FIG. 1, it is impossible to elevate a temperature to a level sufficient for the intended improvement or produce a temperature difference necessary for the intended improvement between the inner and outer faces of a stainless steel pipe unless the portion of the steel pipe where improvement is required to located substantially at the center of the induction element in the widthwise direction thereof. This holds good also with respect to a multi-wound induction element 42 wound entirely at an equal pitch (see FIG. 8).

The characteristic property of the induction element, that is, the property that as the clearance between the material to be heated and the induction element is reduced, a higher heat generation density can be obtained, can be effectively utilized in the method of the present invention without any practical disadvantage. In short, this characteristic property can be conveniently utilized as one means for attaining the object of the present invention.

More specifically, in the method of the present invention, since a multi-wound induction element including a line spirally wound in the form of a coil having an appropriate diameter is employed, the clearance between the material to be heated and the induction element can be easily changed in advance or in situ by changing the diameter of the line coil in the required portion.

Accordingly, even if the portion of the stainless steel pipe where improvement of the residual stress is required is located in the side end portion of the induction element, the clearance between the pipe and element in this portion can easily be controlled so that reduction of the heat generation density is not caused while the clearance in other portion is controlled so that the heat generation density is not excessively elevated to too high a level. Accordingly, substantially uniform heating necessary for improving the residual stress can be attained substantially along the entire width of the induction element.

As pointed out hereinbefore, in the conventional method, if it is impossible to locate the vicinity of the welded portion substantially at the center of the induction element, the residual stress in the vicinity of the welded portion cannot be improved at all. In the present invention, by virtue of the feature that in one or both of the side end portions of a multi-wound induction element the clearance between the induction element and the material to be heated and/or the winding pitch is appropriately controlled in the above-mentioned manner and induction heating is carried out by using this multi-wound induction heating element, the residual stress can be improved sufficiently along the entire width of the induction element wherever the vicinity of the welded portion where improvement of the residual stress is required may be located within the entire width of the induction element. Accordingly, in the method of the present invention, it is possible to improve the residual stress with ease in the vicinity of the welded portion of a stainless steel pipe of a complicated piping system, even if the vicinity of the welded portion is located at such a position that improvement of the residual stress is impossible according to the conventional method.

What is claimed is:

1. In the method for improving the residual stress of the weld in a welded austenitic stainless steel pipe to thereby reduce stress corrosion cracks, in which method the welded pipe is heated in the vicinity of the welded portion thereof from the radial outside thereof by an induction heating element while a fluid coolant is passed through the pipe to cool the inside of the pipe to thereby provide a temperature differential between the radial inside and radial outside of the pipe, the improvement:

wherein the induction heating element is multiturn, and wherein one of (a) the axial spacing between adjacent turns of the induction heating element and (b) the radial distance between the pipe and the heating element is varied so as to produce a predetermined temperature over the area of the weld.

2. The method of claim 1 wherein the spacing between adjacent turns of the induction heating element is varied by varying the pitch of the turns of the induction heating element more on one end of the element than in the center of the element.

3. The method of claim 2 wherein the pitch at one end of the induction heating element is reduced to a value between about 60 percent and about 90 percent of the pitch of the turns of the element nearest the center of the element.

4. The method of claim 3 wherein the length of the element over which the turn spacing is varied is between about two and about three times the distance between the pipe and the element.

5. The method of claim 4 wherein the temperature differential between the radial inside and radial outside of the pipe is not less than about 400° C.

6. The method of claim 1 wherein the distance between the pipe and the element is varied.

7. The method of claim 1 wherein the temperature differential between the radial inside and radial outside of the pipe is not less than about 400° C.

8. The method of claim 7 wherein the pitch at one end of the induction heating element is reduced to a value between about 60 percent and about 90 percent of the pitch of the turns of the element nearest the center of the element.

9. The method of claim 1 wherein the length of the element over which one of the spacing and the distance are varied is between about two and about three times the distance between the pipe and the element.

* * * * *